United States Patent [19]

Davis

[11] 4,057,749

[45] Nov. 8, 1977

[54] TRAVELLING WAVE TUBE HAVING AN IMPROVED MAGNETIC FOCUSSING FIELD

[75] Inventor: Peter Robert Davis, Chelmsford, England

[73] Assignee: English Electric Valve Company Ltd., England

[21] Appl. No.: 673,348

[22] Filed: Apr. 2, 1976

[30] Foreign Application Priority Data

Apr. 3, 1975 United Kingdom ..... 13588/75

[51] Int. Cl.[2] ..... H01J 25/34

[52] U.S. Cl. ..... 315/3.5; 315/3.6; 315/5.35

[58] Field of Search ..... 315/3.5, 3.6, 5.35

[56] References Cited

U.S. PATENT DOCUMENTS

| | | | |
|---|---|---|---|
| 2,945,153 | 7/1960 | Chang | 315/3.5 |
| 2,965,782 | 12/1960 | Weaver | 315/3.5 X |
| 3,252,033 | 5/1966 | Orui | 315/3.5 X |
| 3,259,788 | 7/1966 | Orui | 315/3.5 |
| 3,259,790 | 7/1966 | Goldfinger | 315/3.5 |

*Primary Examiner*—Saxfield Chatmon, Jr.
*Attorney, Agent, or Firm*—Diller, Brown, Ramik & Wight

[57] ABSTRACT

The magnetic field produced by the periodic permanent magnets of a travelling wave tube is shaped to improve the transmission ratio of the electron beam. The first zero magnetic field occurs within the magnet region, and the first peak magnetic field occurs at the first minima of the diameter of the electron beam.

5 Claims, 2 Drawing Figures

Figure 1:
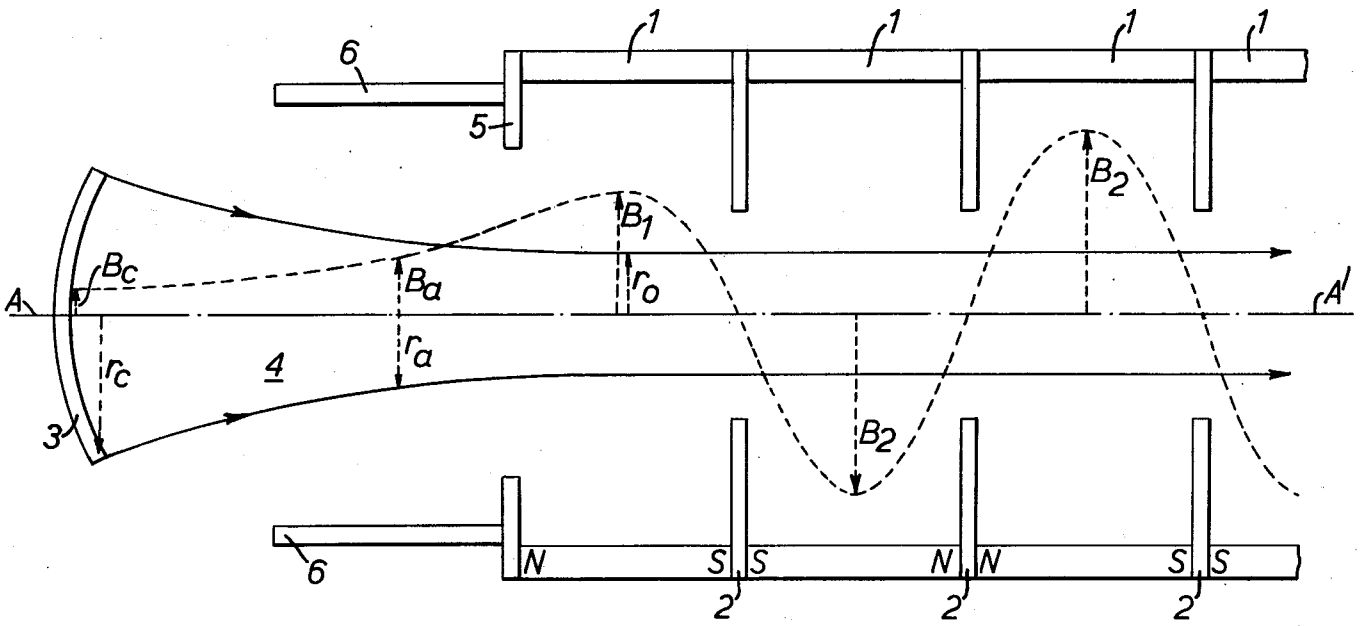

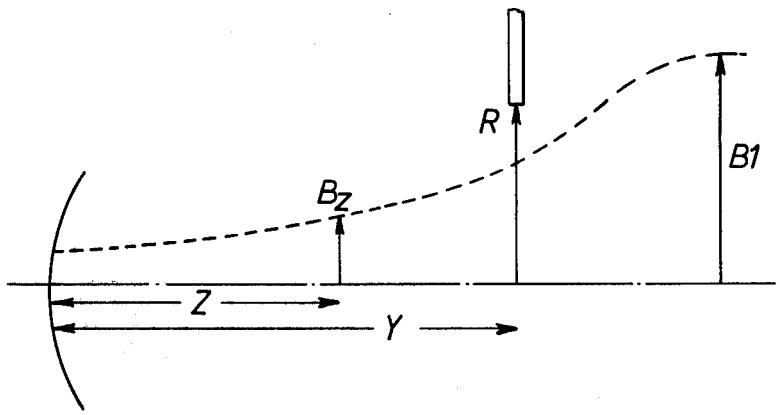
FIG. 2.
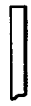

TRAVELLING WAVE TUBE HAVING AN IMPROVED MAGNETIC FOCUSSING FIELD

This invention relates to travelling wave tubes, and is concerned with the magnetic field which is used to focus the electron beam in such tubes. As is known, travelling wave tubes are used to produce amplification of very high frequency electrical signals with little distortion, and this is achieved by coupling a low power high frequency signal onto the electron beam so as to produce a velocity modulation thereof. Because of the mutual repulsion of the negative electrons a magnetic focussing field is used to prevent the electron beam spreading. Although the magnetic field can be provided by an electro-magnet surrounding the travelling wave tube, it is increasingly desirable for it to be provided by a permanent magnet arrangement which produces a periodic magnetic field. The permanent magnet arrangement can be made relatively light, and it avoids the need to provide the large electric currents needed to energise the electro-magnets used previously, but difficulties arise in correctly shaping the periodic magnetic field at the point where the electron beam enters it, and the present invention seeks to provide a travelling wave tube having an improved focussing arrangement.

According to this invention a travelling wave tube includes a periodic permanent magnet focussing structure for its electron beam, the first peak value of the periodic magnetic field being less than the immediately following peak values, and the first zero magnetic field encountered by the electron beam being within said permanent magnet focussing structure and lying between the position of said first peak and the next following peak.

The values of the immediately following peaks can all be equal to each other, but this is not essential and in cases where a very gradual entry transition is desirable, one or more intermediately valued peaks can be provided.

Preferably the source of the electron beam is an electron gun arrangement which produces an initially converging electron beam, and preferably again said first peak value of the periodic magnetic field occurs at the point where the diameter of the electron beam attains its first minima.

Preferably the electron gun arrangement is situated in a magnetic field having lines of magnetic flux which follow the converging trajectories of the electrons emitted by the cathode of the electron gun.

The first peak value of the periodic magnet field is related to the so-called Brillouin value by a factor *m*, where *m* is between one and two and, typically is about 1.5. The Brillouin value is the axial magnetic field strength required to cause rotation of the electron beam about its own axis whilst maintaining the mean diameter of the beam fairly constant. The effect of coupling a high frequency signal onto the electron beam so as to produce power amplification of the signal causes velocity modulation of the individual electrons within the electron beam and gives rise to pertubations or variations in the diameter of the electron beam, (this effect is sometimes called "scalloping"). In order to minimise the magnitude of these pertubations the axial magnetic field is increased above the Brillouin value by a factor. *m*. The value of this factor *m* is often derived empirically, but a value of about 1.5 is acceptable.

Preferably the first peak value of the periodic magnetic field is substantially equal to the root mean square (r.m.s.) value of the peak value of the following equally valued peaks.

This invention is further described, with reference to the accompanying drawings in which:

FIG. 1 illustrates, in diagrammatic fashion, a portion of a travelling wave tube in accordance with the present invention, and FIG. 2 is an explanatory diagram.

Referring to FIG. 1, which is not to scale, there is shown therein a portion of a travelling wave tube in which the periodic magnet focussing field is provided by a permanent magnet structure consisting of a sequence of ring magnets 1. These are poled in alternating succession, as shown by the letters N.and S. which represent the north and south poles, to produce a regular periodicity in the axial magnetic field present on the axis AA' of the travelling wave tube. Each ring magnet 1 is spaced apart from adjacent ring magnets 1 by a pole piece 2 which efficiently extends the magnetic field to the axis AA'. At the one end of the magnetic focussing structure there is provided a dish shaped cathode 3 which emits an electron beam 4. The cathode 3 itself forms part of an electron gun having the usual accelerating electrodes to shape the electron beam and impart required energy to it. These electrodes, being conventional are not separately shown. The electron beam passes along the axis AA' and is collected at the far end of the travelling wave tube by an electron collector (not shown).

The pole pieces 2 also form part of the resonant cavity structure of the travelling wave tube. Essentially this consists of a number of resonant cavities by means of which a relatively low power high frequency signal can be superimposed onto the electron beam in the form of a velocity modulation of the electrons emitted by the cathode 3. A number of such cavities may be located between each adjacent pair of pole pieces 2, or each pair of pole pieces can themselves represent the boundaries of a cavity. The nature and construction of cavities of this kind are well known (e.g. as shown in our pending U.S. pat. application nos. 7682/73, 1/5760/V and 1/5773/V.) Together the cavities constitute what is commonly termed a slow-wave structure.

The ring magnets 1 and the pole pieces 2 are so chosen that the peak magnetic field $B_1$ is equal to the Brillouin value multiplied by a factor *m*. The value of *m* is about 1.5. As already mentioned the Brillouin value is that value which causes rotation of the electron beam about the axis AA' whilst producing theoretically no alteration in beam diameter. The effect is to counteract the mutual repulsion of the individual electrons in the beam, and to prevent the tendency for the beam to spread. The first pole piece 5 is provided with a larger central aperture than pole pieces 2, and the effect of this is to make the peak field $B_1$ less than the immediately following peak field values $B_2$. It is arranged that $B_1$ equals the r.m.s. value of $B_2$. ie. $B_2 = \sqrt{2}\, B_1$. In an alternative arrangement one or more peaks intermediate in value between $B_1$ and $B_2$ can be provided after the position of the first peak $B_1$ to provide a more gradual entry transition for the electron beam.

In a conventional travelling wave tube in which the focussing magnetic field is provided by an electromagnet, the substantially constant field strength corresponds to the peak value $B_1$ of the present invention.

The electron beam on entering the periodic magnetic field is thus subjected to the optimum value $m\ B_1$. The presence of the low power signal which is to be amplified produces a velocity modulation of the electron beam which accentuates the tendency of the electron beam to exhibit periodic variations in diameter as it proceeds along the axis of the tube. These periodic variations are restricted to acceptable levels by the presence of the field already referred to which has peak values of $B_2$.

Pole piece 5 is provided with an axial extension 6 which takes the form of a short open-ended cylinder of magnetic material, such as soft iron, the purpose of which is to produce an axial magnetic field within the electron gun itself. The magnetic field strength is shown by the broken line and it increases smoothly from an axial value $B_c$ at the cathode surface to an axial value $B_a$ at the position of the anode (not shown) of the electron gun. The values of $B_a$ and $B_c$ are related by the expression $B_a r_c^2 = B_c r_c^2$ where $r_a$ and $r_c$ are the radial dimensions of the electon beam at the anode and cathode respectively. A field of this shape produces magnetic flux lines which approximately follow the individual electron trajectories, and thus the electrons experience a gradually increasing axial magnetic field until the first peak value $B_1$ is reached.

The value of $B_c$ is related to that of $B_1$ by the expression $$B_c = B_1 \frac{r_o^2}{r_c^2} \sqrt{1 - \frac{1}{m^2}}$$

where $r_o$ is the radial dimension of the electron beam at the position of the first peak value $B_1$. It will be noted that when $m = 1$, i.e. when the first peak value $B_1$ equals the theoretical Brillouin value $B_B$, the value of $B_c$ becomes zero. Using the previously stated relation $B_2 = \sqrt{2} \cdot B_1$, the various field values can be rewritten in a form dependent only on beam radii, $$B_2^2 = 2\left(B_B^2 + B_c^2 \frac{r_c^4}{r_o^4}\right)$$

The ratio of $B_1$ to $B_2$ can be further modified by altering the strength of the first ring magnet 1. If each ring magnet is made up of a number of elongate axially aligned magnets positioned side by side, a reduction in the value of $B_1$ can be achieved simply by removing some of these elongate magnets. The actual shape of the magnetic field in the region of the aperture in the pole piece 5 is given by the following expression, where R is the radius of this aperture, $$B_Z = \frac{B_1}{\pi}\left[\tan^{-1}\left(\frac{1}{\frac{Y-Z}{R}}\right) \frac{-\left(\frac{Y-Z}{R}\right)}{1+\left(\frac{Y-Z}{R}\right)^2}\right]$$

The extension 6 can consist of a further ring magnet, and can be poled in the same sense as the first ring magnet 1, or can be poled in the opposite sense to the first ring magnet 1 to either increase or decrease the ratios $B_c/B_1$ and $B_c/B_a$ as required.

The anode is situated very close to the cathode, typically only 1 inch apart, and the distance from the anode to the position of the first peak field $B_1$ is also only 1 inch. The present invention permits the entry conditions for the electron beam as it enters the periodic focussing field to be met, without the need to provide an excessively long electron gun arrangement. Typical approximate values for the various field strengths, which are given solely by way of example so that the magnitudes involved may be appreciated, are as follows: $B_B = 356$ gauss, $B_i = 534$ gauss, $B_2 = 755$ gauss, $B_c = 0.12B_1$, and $B_a = 3B_c$ assuming $m = 1.5$. a travelling wave tube of this kind is primarily intended for use at beam power levels in excess of 1 Megawatt.

I claim:

1. A travelling wave tube having an electron gun arrangement which produces an initially converging electron beam and a periodic permanent magnetic focussing structure in which the first peak value of the periodic magnetic field encountered by the electron beam is less than the immediately following peak values, the electron gun arrangement and the periodic permanent magnetic focussing structure being arranged so that the position of said first peak value and the position where the diameter of the electron beam attains its first minima coincide, and the periodic permanent magnetic focussing structure being further arranged so that the first zero magnetic field encountered by the electron beam is within the structure itself and is between the position of said first peak and the next following peak.

2. A travelling wave tube as claimed in claim 1 and wherein the electron gun arrangement is situated in a magnetic field having lines of magnetic flux which follow the converging trajectories of the electrons emitted by the cathode of the electron gun.

3. A travelling wave tube as claimed in claim 1 and wherein the first peak value of the periodic magnetic field is substantially equal to the root means square (r.m.s.) value of the peak value of the following equally valued peak.

4. In a travelling wave tube having a periodic permanent magnet focussing structure comprising a series of spaced pole pieces each having a central aperture and permanent ring magnet structures interposed between said pole pieces, and cathode means spaced from one end of said focussing structure in axial alignment with said apertures for emitting an electron beam which converges in that region between said cathode means and the first pole piece of said focussing structure, the improvement wherein:

said first pole piece, the pole piece next following said first pole piece and the permanent ring magnet structure interposed therebetween produce a first peak of the periodic magnetic field located axially between such pole pieces and which has a value $B_1$ equal to m $B_B$, where $B_B$ is the Brillouin value which is the axial magnetic field strength required to cause rotation of the electron beam about its own axis while maintaining the mean diameter of the beam fairly constant, and m is about 1.5;

said focussing structure providing a plurality of second peaks of the periodic magnetic field beyond said first peak which have a value $B_2$ equal to $\sqrt{2}$ $B_1$; and said focussing structure providing a magnetic field which causes the first minimum diameter of said electron beam to occur in coincidence with the location of said first peak having the value $B_1$.

5. In a travelling wave tube as defined in claim 4 wherein said periodic permanent magnet focussing structure includes a ring magnet extending from said first pole piece toward said cathode means.

* * * * *